US008446062B2

(12) United States Patent
Eger et al.

(10) Patent No.: US 8,446,062 B2
(45) Date of Patent: May 21, 2013

(54) BRUSH HOLDER ASSEMBLIES

(75) Inventors: Leo A. Eger, Murrysville, PA (US); John Parslow, Scotia, NY (US)

(73) Assignee: Wabtec Holding Corp., Wilmerding, PA (US)

( * ) Notice: Subject to any disclaimer, the term of this patent is extended or adjusted under 35 U.S.C. 154(b) by 0 days.

(21) Appl. No.: 13/271,329

(22) Filed: Oct. 12, 2011

(65) Prior Publication Data

US 2013/0038170 A1 Feb. 14, 2013

Related U.S. Application Data

(60) Provisional application No. 61/574,740, filed on Aug. 8, 2011.

(51) Int. Cl.
*H01R 39/40* (2006.01)
*H01R 39/38* (2006.01)

(52) U.S. Cl.
USPC ..... 310/242; 310/245; 310/247

(58) Field of Classification Search
USPC ..... 310/245–247
See application file for complete search history.

(56) References Cited

U.S. PATENT DOCUMENTS

| | | | | |
|---|---|---|---|---|
| 1,126,546 | A | | 1/1915 | Mattman |
| 1,519,304 | A | | 12/1924 | Hague |
| 1,727,917 | A | | 9/1929 | Zerbo |
| 1,756,692 | A | | 4/1930 | Leland |
| 2,134,511 | A | | 10/1938 | Hague et al. |
| 2,275,613 | A | * | 3/1942 | Cullin ..... 310/245 |
| 2,358,958 | A | * | 9/1944 | Brown ..... 310/249 |
| 2,537,714 | A | | 1/1951 | Spielman |
| 2,986,666 | A | | 5/1961 | Tsutsumi |
| 3,005,078 | A | | 10/1961 | Mottu et al. |
| 3,006,063 | A | | 10/1961 | Linan |
| 3,025,421 | A | | 3/1962 | Sievert |
| 3,212,041 | A | | 10/1965 | Dixon |
| 3,387,155 | A | | 6/1968 | Krulls |
| 3,432,708 | A | | 3/1969 | Bissett |
| 3,466,481 | A | | 9/1969 | Sckerl |
| 3,628,051 | A | | 12/1971 | Chigirinshy et al. |
| 3,710,478 | A | | 1/1973 | Krulls et al. |
| 3,864,803 | A | | 2/1975 | Ohmstedt et al. |
| 4,238,703 | A | * | 12/1980 | Yoshida ..... 310/242 |
| 4,296,346 | A | | 10/1981 | Ooki et al. |
| 4,329,612 | A | | 5/1982 | Averill |
| 4,355,254 | A | | 10/1982 | Oki et al. |
| 4,607,184 | A | | 8/1986 | Takahashi et al. |
| 5,043,619 | A | | 8/1991 | Kartman, Jr. |
| 5,089,735 | A | | 2/1992 | Sawaguchi et al. |
| 5,159,222 | A | | 10/1992 | Southall |
| 5,256,925 | A | | 10/1993 | Cutsforth |
| 5,397,952 | A | * | 3/1995 | Decker et al. ..... 310/242 |
| 5,463,264 | A | | 10/1995 | Koenitzer |
| 5,696,418 | A | | 12/1997 | Corbach et al. |
| 5,793,141 | A | | 8/1998 | Simonsen et al. |
| 5,939,812 | A | | 8/1999 | Wetzel |

(Continued)

FOREIGN PATENT DOCUMENTS

| | | | |
|---|---|---|---|
| GB | 2302999 | * | 2/1997 |

*Primary Examiner* — Burton Mullins
(74) *Attorney, Agent, or Firm* — The Webb Law Firm

(57) ABSTRACT

Brush holder assemblies are detailed. The assemblies may employ rails, rather than boxes, for supporting brushes. They additionally may extend along all, or substantially all, of the lengths of the brushes for enhanced support of the brushes.

18 Claims, 3 Drawing Sheets

U.S. PATENT DOCUMENTS 7,298,065 B2 * 11/2007 Lau ..... 310/242
7,365,470 B1 4/2008 Eger et al.
7,608,970 B2 10/2009 Eger et al.
7,675,216 B1 3/2010 Eger
2010/0038990 A1 * 2/2010 Qin et al. ..... 310/242

* cited by examiner

BRUSH HOLDER ASSEMBLIES

CROSS-REFERENCE TO RELATED APPLICATION

This application claims the benefit of U.S. Provisional Application Ser. No. 61/574,740, filed Aug. 8, 2011, titled "Brush Holder-Rail Support System," the entire contents of which are hereby incorporated by reference.

FIELD OF THE INVENTION

This invention relates to brush holders and associated equipment and more particularly, although not necessarily exclusively, to brush holder assemblies having rails for supporting brushes.

BACKGROUND OF THE INVENTION

Commonly-owned U.S. Pat. No. 7,365,470 to Eger, et al., the contents of which are incorporated herein by this reference, describes and illustrates innovative brush holder assemblies. Included as part of such a brush holder may be a brush box designed to support and restrain some movement of a brush during operation of a rotating device such as a commutator or a slip ring. In this sense the brush holder is conventional, as brush boxes generally are commonly used to support brushes.

Assemblies of the Eger patent have been well-received by users. Further innovations, nevertheless, may continue to improve their functionality, as well as functionality of other brush holders, in some circumstances. For example, brush cooling may be difficult when boxes are used, as the boxes cover much of the surface area of the brushes. Likewise brush maintenance may be difficult because of the surface-area coverage of the boxes. Conversely, because boxes do not typically extend the entire length of brushes (at least when new), they leave portions of the brushes unsupported.

SUMMARY OF THE INVENTION

The present invention improves functionality of existing brush holder assemblies. Unlike conventional such assemblies, those of the present invention provide rails, rather than boxes, for supporting brushes. The rails may cover substantially less surface area of brushes than do boxes, promoting cooling when the brushes are in use and facilitating maintenance when they are not in use. The rails additionally may extend along, and thereby support, entire lengths of the brushes.

Although rails consistent with the present invention may be formed of any suitable material, presently preferred is that they be made of stainless steel because of its strength, abrasion resistance, and resistance to corrosion. Stainless steel additionally has high electrical resistivity (especially as compared to other metals), reducing unintended current flow from the brushes through them to other components. Of course, other electrically-insulating material may be applied or attached to the rails for purposes of further current reduction.

Rails of the invention may be of any appropriate shape and size. They typically will be elongated, however. Presently preferred is that they have semi-circular or rectangular (including square) transverse cross-section, although other cross-sectional shapes may be used as well.

Accordingly, at least some embodiments of the invention will include plates or bodies together with rails and rail supports. A body, from which one or more rail supports outwardly extend, may comprise an electrical connector (such as, but not necessarily, a terminal screw). Preferably a rail support extends from each of its two elongate sides, so that two rails supports are employed in total. Attached to each support, and thereby spaced from the body, is one or more rails. Such attachment advantageously occurs at multiple locations along the length of each rail, although no more than a single attachment location is necessary. Alternatively, any or all of the body, support(s), and rail(s) may be integrally formed.

It thus is an optional, non-exclusive object of the present invention to provide innovative brush holder assemblies.

It is another optional, non-exclusive object of the present invention to provide brush holder assemblies omitting conventional boxes for holding brushes.

It is also an optional, non-exclusive object of the present invention to provide brush holder assemblies utilizing rails for purposes of bounding or retaining brushes in correct positions.

It is a further optional, non-exclusive object of the present invention to provide brush holder assemblies facilitating cooling of brushes, maintenance of brushes, or both.

It is, moreover, an optional, non-exclusive object of the present invention to provide brush holder assemblies in which brushes may be supported along all, or substantially all, of their lengths by rails.

Other objects, features, and advantages of the present invention will be apparent with reference to the remaining text and the drawings of this application.

DETAILED DESCRIPTION

Figure 1A:
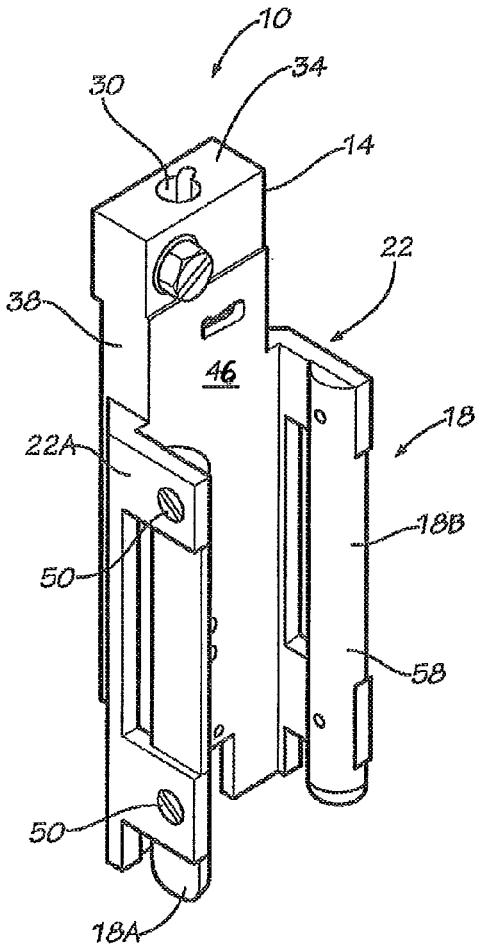
FIG. 1A is a perspective view of an exemplary brush holder assembly of the present invention.
Figure 1B:
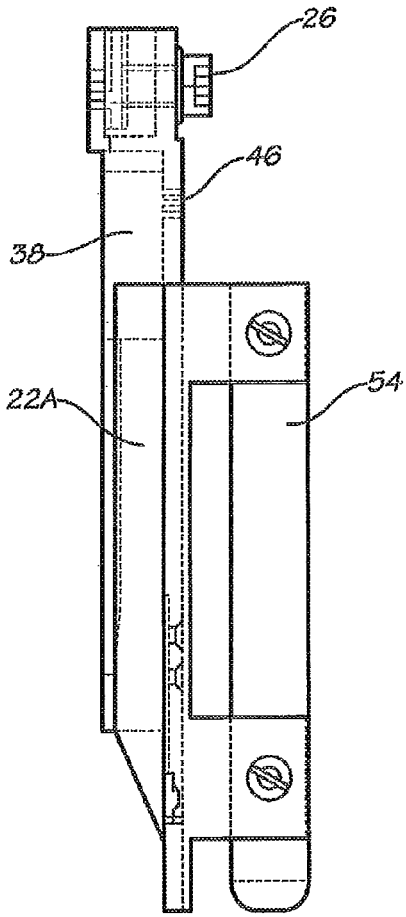
FIG. 1B is a side view of the assembly of FIG. 1A.
Figure 1C:
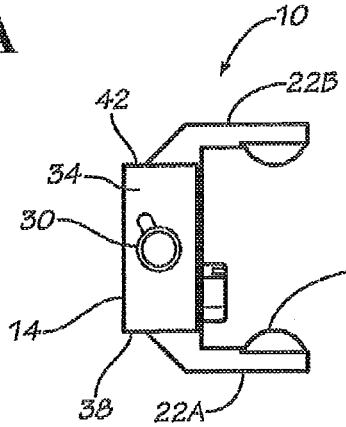
FIG. 1C is a top view of the assembly of FIG. 1A.

Depicted in FIGS. 1A-C is a version of brush holder assembly 10. Assembly 10 may comprise plate or body 14, rails 18, and rail supports 22. It also may include an electrical connector, shown as being terminal screw 26, and optionally a bore 30 for receiving a handle (for example).

Body 14 may be elongate and configured for connection to another object. It may (but need not necessarily) be generally rectangular in shape and define nominally top surface 34 (in which bore 30 may be formed), first and second sides 38 and 42, respectively, and face 46 spanning the sides 38 and 42. One or more elongate supports 22 may connect to one or more of sides 38 and 42. As shown in FIGS. 1A-C, support 22A connects to side 38, whereas support 22B connects to side 42. Such connection may occur in any appropriate manner, or supports 22 may be integrally formed with body 14.

Attached to each support 22 may be rail 18. Each rail 18 too is elongate and preferably of length exceeding—or at least approximating—that of brush B (see FIGS. 2A-C). Each rail 18 additionally is of width less than the width of its associated support 22, so that support 22 spaces the rail 18 from face 46. FIGS 1A-B show two fasteners 50 attaching rail 18A to support 22A, for example, although other connection means (including integral formation) may be employed instead for either or both of rails 18A and 18B.

Figure 2A:
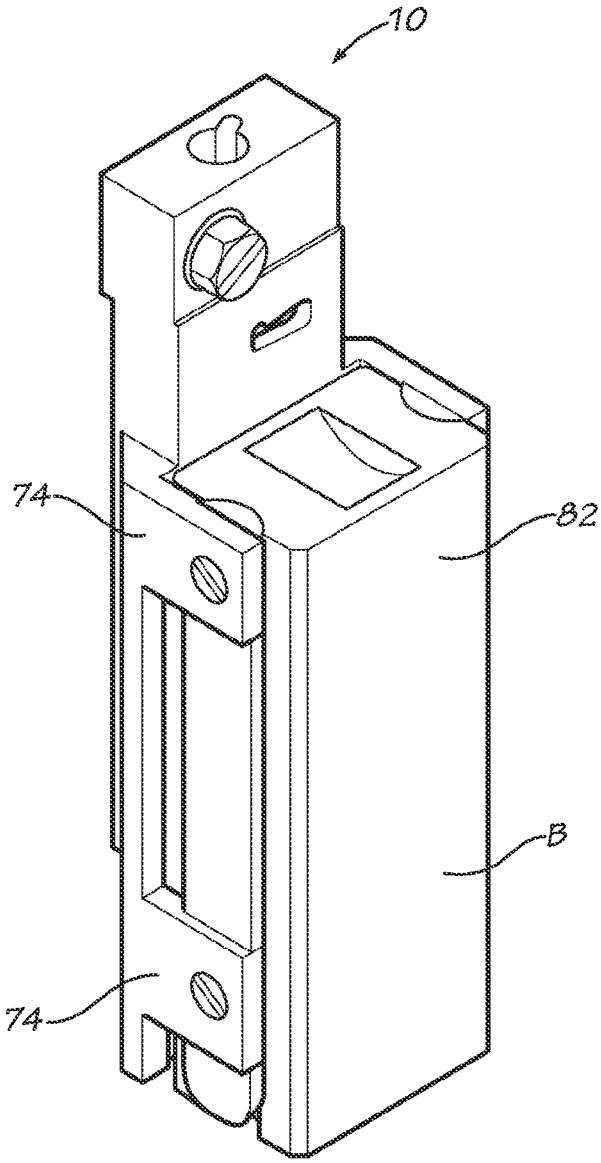
FIGS. 2A-C correspond, respectively, to FIGS. 1A-C but also illustrate a brush positioned within the assembly.
Figure 2B:
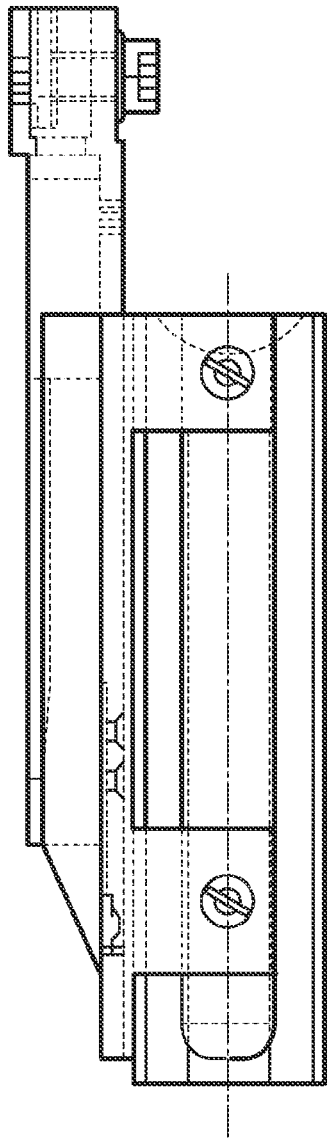
Figure 2C:
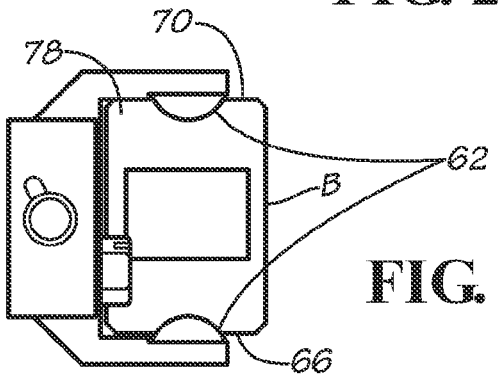

Rails 18 may have semi-cylindrical shape, with their flat portions 54 abutting supports 22. Curved portions 58, by contrast, are configured to be received by corresponding curved cut-outs 62 in brush B. Cut-outs 62 extend the length of opposing sides 66 and 70 of brush B; FIGS. 2A-C illustrate rails 18 received by cut-outs 62 so as to position brush B within assembly 10.

As depicted especially in FIGS. 2A-B, each support 22 may be generally "C" shaped in side view. Because only the shorter, flange portions 74 of the "C" together with rails 18 are adjacent each side 66 or 70 of brush B, substantial portions of sides 66 and 70 remain uncovered. Similarly, although face 78 of brush B abuts face 46 of body 14, opposed face 82 of brush B is completely uncovered. Because exposed, these portions 66 and 70 and face 82 of brush B may be more easily cooled and maintained than if a box were used. Stated differently, because the perimeter (comprising sides 66 and 70 and faces 78 and 82) of brush B is not surrounded (as it would be if a box were employed), it is easier to cool the brush B and maintain the brush holder.

Figure 3:
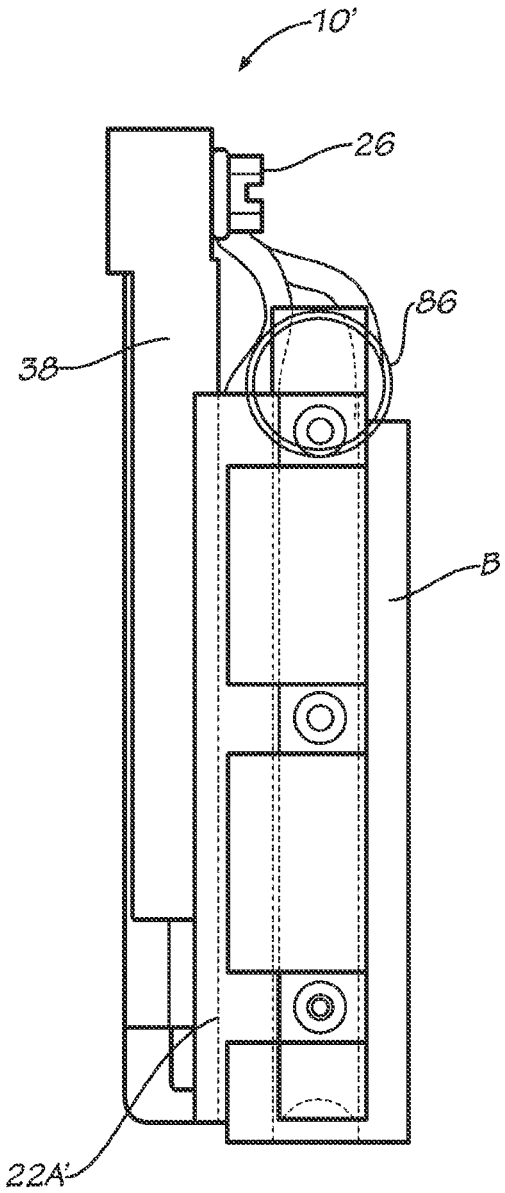
FIG. 3 provides a side view similar to that of FIG. 2B but for a first alternate brush holder and illustrating a spring and electrical lead.

FIG. 3 shows ribbon spring 86, which may bias brush B toward a rotating device (as described in the Eger patent). Also illustrated in FIG. 3 are at least one lead L configured to provide electrical connection between brush B and terminal screw 26. Support 22A additionally is depicted as including three fasteners 50 for attachment of the corresponding rail 18, thus providing a first alternate version of assembly 10 denoted assembly 10'.

Figure 4:
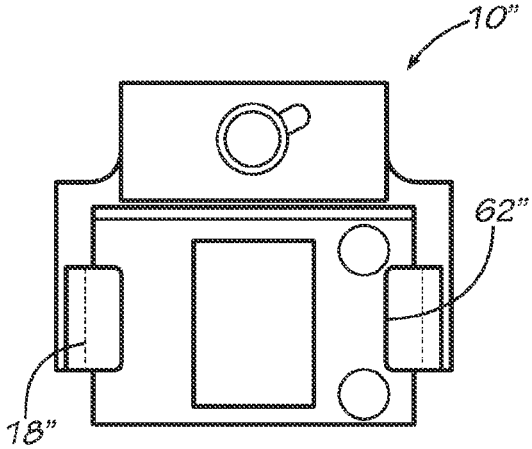
FIG. 4 is a top view of a second alternate brush holder assembly consistent with the present invention.

FIG. 4, finally, illustrates in top view a second alternate version of assembly 10, denoted assembly 10". Assembly 10" may be similar to either of both of assemblies 10 and 10', albeit with rails 18" forming a rectangular prism, or generally so, rather than semi-cylindrical in shape. Cut-outs 62" of brush B consequently likewise are generally rectangular so they may receive rails 18". Persons skilled in the art of the invention will recognize that the rails and cut-outs need not have either semi-cylindrical or rectangular prismatic shapes, but rather may be shaped in any desired complementary manners.

The foregoing is provided for purposes of illustrating, explaining, and describing exemplary embodiments and certain benefits of the present invention. Modifications and adaptations to the illustrated and described embodiments will be apparent to those skilled in the relevant art and may be made without departing from the scope or spirit of the invention.

We claim:

1. A brush holder assembly comprising:

a. an elongate body having a first end and a second end that define a length extending in a longitudinal direction, the body having first and second sides with a face extending between the first and second sides, and with the face of the body configured to continuously abut a brush positioned in the assembly when in use;

b. at least one support connected to or integrally formed with the body, the at least one support extending in a direction away from the face of the body;

c. at least one rail connected to or integrally formed with the at least one support, the at least one rail having a length extending in the longitudinal direction; and d. a spring configured to bias a brush in the longitudinal direction when positioned in the assembly when in use, and in which the at least one support and the at least one rail do not surround a perimeter of a brush positioned in the assembly when in use.

2. A brush holder assembly according to claim 1 in which the at least one support comprises first and second supports, the first support connected to or integrally formed with the first side and the second support connected to or integrally formed with the second side.

3. A brush holder assembly according to claim 2 in which the at least one rail comprising first and second rails, the first rail connected to or integrally formed with the first support and the second rail connected to or integrally formed with the second support.

4. A brush holder assembly according to claim 3 in which the first rail is elongate and has either semi-circular or rectangular transverse cross-section.

5. A brush holder assembly according to claim 4 in which the first rail is configured to be received by a cut-out of a brush in use.

6. A brush holder assembly according to claim 5 in which the first support comprises flange portions.

7. A brush holder assembly according to claim 6 in which the flange portions of the first support are attached to the first rail.

8. A brush holder assembly according to claim 7 in which the second rail is elongate and has either semi-circular or rectangular transverse cross-section.

9. A brush holder assembly according to claim 8 in which the second rail is configured to be received by a cut-out of a brush in use.

10. A brush holder assembly according to claim 9 in which the second support comprises flange portions.

11. A brush holder assembly according to claim 10 in which the flange portions of the second support are attached to the second rail.

12. A brush holder assembly according to claim 1 in which the at least one rail is spaced from the body via the at least one support.

13. A brush holder assembly comprising:

an elongate body having a first end and a second end that define a length extending in a longitudinal direction, the body having first and second sides with a face extending between the first and second sides, and with the face of the body configured to continuously abut the brush when in use;

at least one support connected to or integrally formed with the body, the at least one support extending in a direction away from the face of the body;

at least one rail connected to or integrally formed with the at least one support, the at least one rail extending in the longitudinal direction; and a brush having a length defined by a first end and a second end, the first end configured to contact a rotating device, the brush defining at least one cutout having a length that extends along the length of the brush in the longitudinal direction.

14. A brush holder assembly according to claim 13, further comprising a spring configured to bias the second end of the brush in the longitudinal direction.

15. A brush holder assembly according to claim 13 in which the at least one rail is spaced from the body via the at least one support.

16. A brush holder assembly according to claim 13 in which the at least one cutout receives at least a portion of the at least one rail.

17. A brush holder assembly according to claim 16 in which the at least one cutout extends the entire length of the brush.

18. A brush holder assembly according to claim 13 in which the at least one support comprises first and second supports, the first support connected to or integrally formed with the first side and the second support connected to or integrally formed with the second side.

* * * * *